US006158512A

United States Patent [19]

Unsgaard

[11] Patent Number: 6,158,512

[45] Date of Patent: Dec. 12, 2000

[54] METHOD AND APPARATUS FOR THE REMOVAL OF SAND IN AN UNDERWATER WELL

[75] Inventor: Tom Unsgaard, Stavanger, Norway

[73] Assignee: Testtech Services AS, Stavanger, Norway

[21] Appl. No.: 09/078,297

[22] Filed: May 13, 1998

[30] Foreign Application Priority Data

Oct. 27, 1997 [NO] Norway ..... 974950

[51] Int. Cl.[7] ..... E21B 27/00

[52] U.S. Cl. ..... 166/311; 166/105.1; 166/107; 166/99; 166/162; 166/53

[58] Field of Search ..... 166/105.1, 105.3, 166/107, 110, 311, 312, 99, 162, 167, 168, 53

[56] References Cited

U.S. PATENT DOCUMENTS

| | | | |
|---|---|---|---|
| 1,466,773 | 9/1923 | Trew | 166/311 |
| 2,700,567 | 1/1925 | Fortenberry | 166/99 |
| 2,909,225 | 10/1959 | Hanes et al. | 166/312 |
| 3,572,431 | 3/1971 | Hammon | 166/99 |
| 4,190,113 | 2/1980 | Harrison | 166/311 |
| 4,603,739 | 8/1986 | Krugh | 166/311 |
| 4,744,420 | 5/1988 | Patterson | 166/312 |
| 5,033,545 | 7/1991 | Sudol | 166/312 |
| 5,086,842 | 2/1992 | Cholet | 166/312 |
| 5,095,976 | 3/1992 | Appleton | 166/105.1 |
| 5,176,208 | 1/1993 | Lalande et al. | 166/99 |
| 5,318,128 | 6/1994 | Johnson et al. | 166/312 |

FOREIGN PATENT DOCUMENTS

| | | |
|---|---|---|
| 523514 | 4/1931 | Germany . |
| 197 21 823 | 7/1998 | Germany . |
| 68983 | 3/1945 | Norway . |
| 300282 | 5/1997 | Norway . |

*Primary Examiner*—Eileen D. Lillis
*Assistant Examiner*—John Kreck
*Attorney, Agent, or Firm*—Knobbe, Martens, Olson & Bear LLP

[57] ABSTRACT

A sand removing apparatus which is intended to be used in the lower area of underwater wells and is suspended from the end of a pipe string, includes a container having a closeable inlet for allowing a flow of liquid accompanied by sand thereinto. The container has a separate outlet assigned a suction side of a pump constituting the drive device for the apparatus. The drive device is kept going until a degree of filling of the container has been achieved. Between a separate inlet provided with a one-way valve and the separate outlet, a filter is disposed, so that sand remains in the container while the carrier liquid exits the container. In one embodiment, the drive device is a liquid-driven jet jump.

6 Claims, 2 Drawing Sheets

METHOD AND APPARATUS FOR THE REMOVAL OF SAND IN AN UNDERWATER WELL

FIELD OF THE INVENTION

The invention relates to an apparatus for the removal of sand, especially in the lower area of the well, in connection with the recovery of oil or gas, said apparatus comprising a displaceable sand-accommodating container having a closeable inlet for the sand's flowing into the container and an outlet for removing the sand from the container subsequent to the displacement thereof, at a suitable place. Likewise, the invention concerns use of a jet pump (ejector) in connection with such sand removal.

BACKGROUND OF THE INVENTION

In the production of oil and gas, it is a constantly occuring problem that sand is torn loose from the formation, accompanying the oil and/or gas into the well. Sand following the flow of oil or gas, so-called produced sand, may cause great damage on production equipment, both within and outside the well.

The amount of produced sand increases with increasing flow rate, and an important measure against sand production is, thus, to limit the flow rate. Measuring equipment has been developed in order to detect produced sand, so that sand-reducing measures may be carried out prior to the production equipment has been damaged to such a degree that it has to be repaired.

Additionally, it is common to strengthen formations easily giving away sand, e.g. by injecting sand to which a binding agent, e.g. sand/gravel admixed an adhesive agent of the type referred to as "glue gravel". Also, known filters of a plurality of types are installable in the well in order to prevent loose sand from accompanying the flow up through the well.

After some time of use, the lower part of the well is filled with loose sand, and it becomes increasingly difficult to maintain an acceptable flow rate. Upon maintenance of a well, it is, therefore, usual to try to remove loose sand gathered at the bottom of the well. Loose sand may also result from drilling or other work within the well, and one tries to remove such sand before production start.

A common way of removing sand is to circulate liquid within the well. Liquid pumped down towards the bottom through a pipe string, conveys sand to the surface upon return through the annulus between pipe string and well wall. It is known to add a gas, e.g. nitrogen, to the liquid in order to increase the effect, but it has been found to be difficult to remove sand satisfactorily in this manner.

Also, it is known to fetch up sand by means of a container lowered down into the well to be filled with sand before it is hoisted up from the well. The container is closed at surface level (before being lowered), so that it will contain air or other gas at atmospheric pressure when it arrives to the lower area of the well where the removal of sand is going to be carried out. At the bottom of the well, the container is opened. This may e.g. happen in that an actuation means included in the release mechanism for the closure body of the container inlet which may be assigned a return device towards closed position, strikes against the well bottom face, thus opening the inlet for a flow of liquid therethrough, bringing sand with it. The well pressure which is substantially higher than the pressure within the container, causes an intense but brief flow of sandy liquid into the container.

When the container is lifted out of the well and the actuation means of the release mechanism no longer is resting itself against the well bottom face, the inlet is closed and the sand conveyed up to the surface, kept within the container. The disadvantage of this known apparatus and the filling method of the container is that the degree of filling becomes small and that removal of sand therefore takes much time. When the container partly filled with sand has reached surface level, where the sand is to be discharged, this takes place through the inlet of this known apparatus, the inlet, thus, acting as outlet in this phase of the process.

SUMMARY OF THE INVENTION

The object of the invention is to provide a simple and efficient apparatus for removing sand from a well.

The object is achieved through features as defined in the following description and claims.

An apparatus according to the invention comprises a container having two separate apertures. One aperture forms a separate inlet and is assigned a one-way valve so that sandy liquid can flow into the container but not return, out of the container.

Between the inlet and the other aperture forming a separate outlet, it is disposed a filter to retain sand brought along with the flowing, circulating liquid within the container. Through the establishment of a suction effect within the container with outflow possibility for sand released liquid, sandy liquid may, thus, be brought to flow into the container at the inlet thereof, filtered liquid flowing out from the container at the outlet thereof and, therefrom, out into the well. The outlet is assigned the suction side of a pump, preferably a jet pump or ejector, driven by a liquid flow supplied thereto from another pump.

The container is lowered into the well and is pulled up therefrom by means of a pipe string, e.g. a coilable tubing coupled to the jet pump. Supplying the jet pump with forced flowing liquid through the pipe string, causes an underpressure to be created within the container. Liquid within the well or liquid operating the jet pump in case the well is filled with gas, takes with it sand and flows into the container through the inlet.

The filter prevents sand from accompanying liquid through the outlet and into the pump. The jet pump may, based on experience, be stopped after a predetermined time has lapsed, or upon the occurrence of a signal from a sensor discharging said signal when the container has reached an acceptable degree of filling. When the container is pulled up from the well, said one-way valve prevents sand from falling out through the inlet.

BRIEF DESCRIPTION OF THE DRAWINGS

In the following, the invention is further described by means of an examplary embodiment, reference being made to attached drawings, wherein.

DETAILED DESCRIPTION OF THE INVENTION

Figure 1:
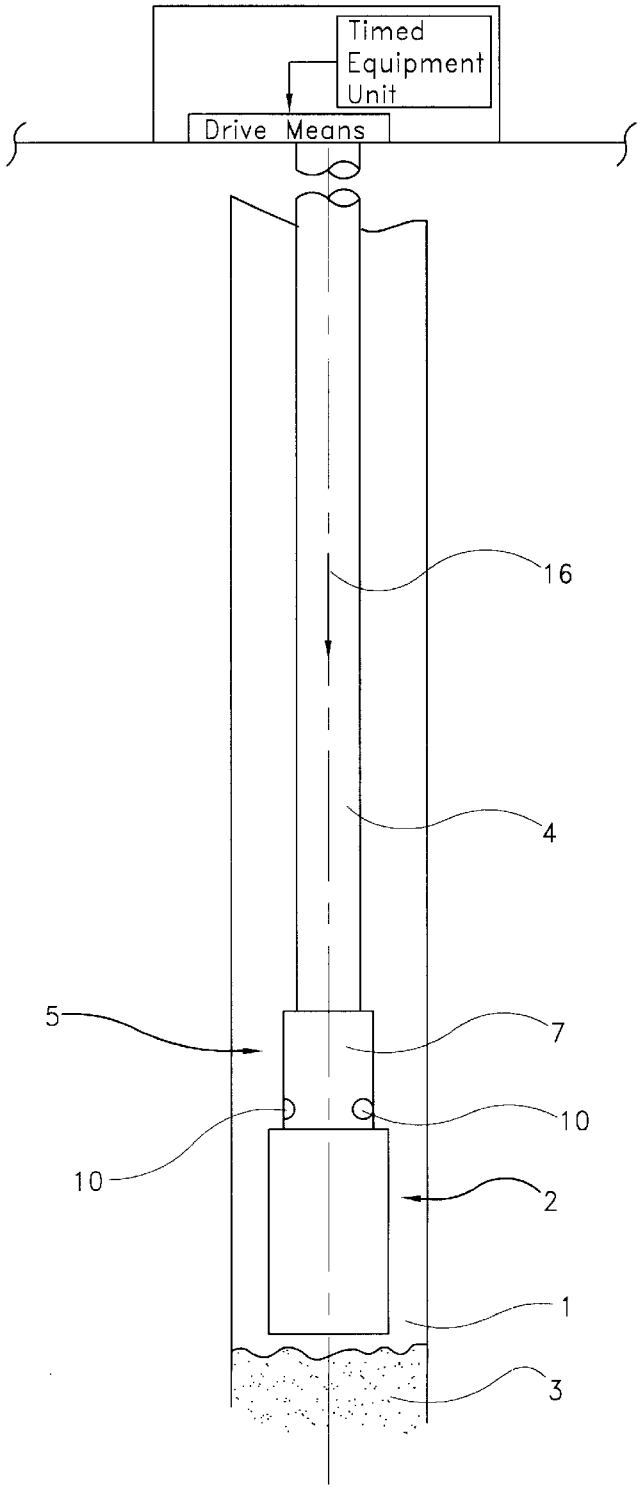
FIG. 1 is a simplified diagrammatical side elevational view, partly in vertical section, showing a well and a therein disposed apparatus for the removal of sand.
Figure 2:
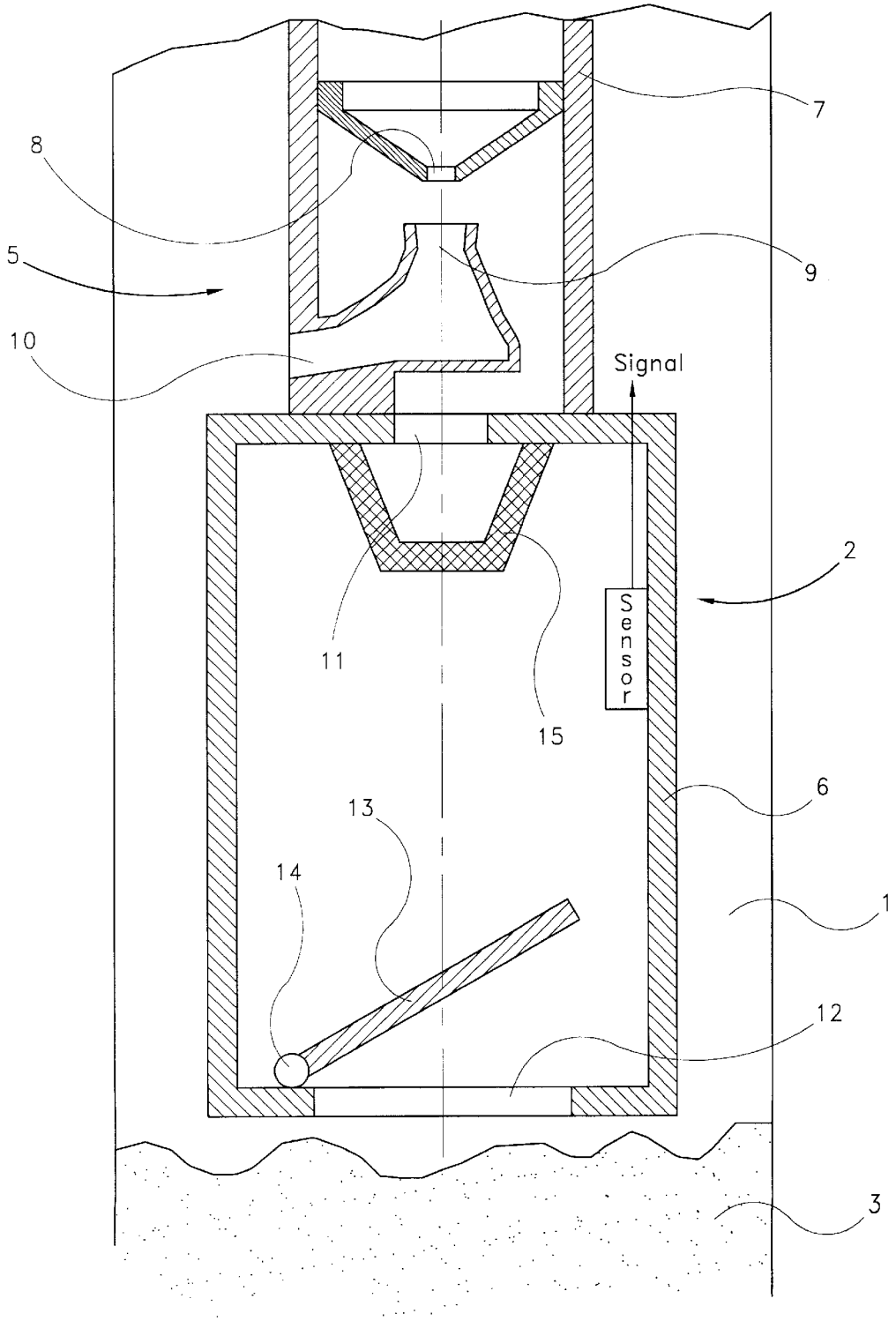
FIG. 2 shows an axial section of the apparatus on a larger scale.

In FIGS. 1 and 2, reference numeral 1 denotes the lower part of a well wherewithin an apparatus 2 has been lowered in order to remove sand 3.

The apparatus 2 is attached to a pipe string 4, e.g. in the form of a coilable tubing, adapted to conduct liquid to a jet pump (ejector) 5 assigned to a container 6 for the accommodation and removal of sand 3.

As known, the jet pump 5 comprises a housing 7. Uppermost within the pump housing 7, a nozzle 8 is disposed. Said nozzle 8 is adapted to create a jet of liquid and pass it with a high speed into one end of a channel 9 which, through one or more lateral gates 10, passes out of the housing 7. The cross-sectional area of the channel 9 increases with increasing spacing from the nozzle 8, the channel 9 being assigned at least one such gate 10 conducting liquid through the wall of the pump housing 7 and outwards into the well 1.

The housing 7 is in connection with the container 6 through an outlet opening 11 in the container 6. At the lower end thereof, the container 6 is provided with an aperture 12 forming an inlet for sandy liquid. A flap 13 which is rotatably attached to the container 6 by means of a hinge 14, is adapted to act as a one-way valve, preventing liquid and sand from flowing out from the container 6 at the inlet 12.

The housing 7 and the container 6 are filled with a liquid which normally will be the same liquid as the one within the well 1. In a well 1 filled with gas, liquid supplied to the pump 5 will gradually fill the lower part of the well 1, so that the container 6 and the housing 7 are filled with liquid.

In the area between the nozzle 8 and the channel 9, liquid flowing out from the nozzle 8 and into the channel 9 takes with it liquid within the housing 7. Liquid which is pumped out of the housing 7 in this manner, is substituted by liquid from the container 6.

Liquid flowing into the container 6 at the inlet 12, takes with it sand 3 from the well 1. A filter 15 prevents sand 3 from being brought into the housing 7 by liquid flowing through the container 6.

Gradually, the container 6 is filled with sand 3, and pumping is terminated, the flap 13 then rotating downwards around the shaft (hinge) 14, taking closing position, thus closing the inlet 12. The pipe string 4 carrying the apparatus 2 is pulled out of the well 1, and the container 6 is discharged, leaving the sand 3 at a desired place (in surface position), whereafter the apparatus 2, possibly, is lowered into the well 1 once more.

In order to give the filter 15 a large surface area in relation to the filter's need of space within the container 6 at the outlet 11 thereof, the filter may have the form of a three-dimensional, hollow cone- or pyramid-shaped body having a downwardly tapering shape, FIG. 2.

It should be clear without saying that—in connection with an apparatus whoose mode of operation is based on the suction action of a pump 5 into the container 6 and the circulation of the sand-conveying liquid into the container inlet 12, through the container 6, out from the outlet thereof after filtering off sand 3 and out through the liquid-driven (arrow 16, FIG. 1) jet pump's 5 one or more lateral gates 10—a degree of filling can be achieved in respect of the container 6 close to 100% if this is desirable. Consequently, through the invention it has been obtained a substantial technical progress with regard to most relevant technique described in the introduction of the specification.

In practice, the degree of filling achieved/desired may be based on time and based on experiences from various sand removing situations, the jet pump 5 being stopped after the expiration of a predetermined time. Alternatively, a sensor can be mounted, e.g. at a level corresponding to the desired top level of an amount of sand. The sensor is actuated, e.g. physically, through the growing sand layer, and is adapted to give a signal which is passed to the jet pump 5 and, possibly, also the one-way valve flap 13, in order to cause the jet pump 5 to stop and the flap 13 to pivot and close the container inlet 12.

The jet pump 5 used to effect the suction of liquid admixed sand (drive liquid 16, often in a mixture with produced liquid) into the sand-accommodating and displaceable container 6 of the sand removing apparatus 2 of the invention, has be found to possess such a superior efficiency and reliability as the drive device of the apparatus 2 that such water-driven jet pumps 5 seem to hold a unique position in the present connection.

Thus, the invention consists, besides the combination of constructive features of the sand removing apparatus, in a use of a jet pump (ejector) as a drive device for the apparatus.

What is claimed is:

1. An apparatus for removing sand from an underwater well as used in connection with a recovery of oil or gas, comprising:

a sand-accommodating container adapted to be opened in order to allow liquid containing such sand into a cavity thereof and in order to discharge therein collected sand therefrom and to be displaceable between a first position in a well area of sand to be removed and a second position at a sand-discharging place, said container having an outlet and a closable inlet through which sand-entraining liquid may be allowed to flow into said container when the inlet is open and the container occupies said first position, said inlet being adapted to be closed during the container's displacement from said first position to said second position;

a sand filter assigned to said outlet and allowing a flow of sand-free liquid to pass therethrough while retaining within said container sand entrained in said liquid; and a jet pump assigned to the container and including a tubular housing in fluid-communication with the cavity of said container through said outlet thereof, said jet pump comprising a nozzle powering the jet pump by means of a carrier fluid flowing therethrough and into a through-going channel having one end opening positioned within an annulus of the well and one end opening adjacent said nozzle and positioned within said tubular housing, said jet pump, when powered, being adapted to establish flowing conditions in sand-entraining liquid within the well causing a flow of sand-entraining liquid into said container's cavity through the inlet thereof, the filtered liquid constituent freed from sand passing out from its outlet while the container occupies its first position, said channel being positioned a first distance from the container and said nozzle being positioned a second distance from the container so that the second distance is greater than the first distance.

2. An apparatus as set forth in claim 1, wherein said container, said outlet thereof, said nozzle and said channel's opening adjacent said nozzle have a common axis, a housing of the jet pump also being coaxial therewith, a second opening of said through-going channel extending through a wall of said jet pump housing.

3. An apparatus as set forth in claim 1, wherein said inlet is provided with a one-way valve, said inlet and said outlet being positioned in opposing end walls of said container, and wherein said filter is disposed immediately adjacent said outlet and has a circumference extending radially outside said outlet as well as being attached sand-tightly to a container end wall in which the outlet is disposed, said filter, in order to provide a large surface area in relation to the need of space thereof within the container, is shaped as one of a hollow cone-shaped and pyramid-shaped body tapering in a direction away from said outlet, the jet pump being assigned a timed equipment unit stopping the jet pump to disrupt circulation of liquid after a predetermined time has lapsed, the predetermined time corresponding to what empirically corresponds to a satisfactory degree of filling of the container with sand, the container being assigned a sensor adapted to react to a growing amount of sand within the container in order to, upon the occurrence of a predetermined enclosed amount of sand corresponding to the desired degree of filling, generate a signal that is transferred to at least the jet pump to stop the jet pump.

4. An apparatus as set forth in claim 3, wherein the one-way valve is a flap valve having a substantially rectangular circumferential shape and is pivotally disposed at one edge to an edge portion of the container defining one side of a rectangular view aperture complementarily corresponding in shape to the substantially rectangular valve flap.

5. An apparatus for removing sand in a lower area of an underwater oil or gas well, comprising:

a displaceable sand-accommodating container having a closeable inlet for allowing a flow of sand into the container together with a carrier fluid in the form of a liquid and for discharging accommodated sand at a suitable place after the container's displacement thereto, the container having an outlet and a filter intermediate the closable inlet and the outlet to retain sand within the container;

a drive device in form of a pump, a suction side of which is assigned to the outlet of the container, the drive device having a pressure side which is in fluid communicating connection with surroundings within the underwater well in order to establish an under pressure within the container to suck in liquid taking with it sand, the liquid being expelled from the container after the sand has been filtered therefrom; and a sensor assigned to the container and adapted to react to a growing amount of sand within the container in order to, upon the occurrence of a predetermined enclosed amount of sand corresponding to a desired degree of filling, generate a signal that is transferred to at least the pump to stop the pump.

6. An apparatus for removing sand in a lower area of an underwater oil or gas well, comprising:

a displaceable sand-accommodating container having a closeable inlet for allowing a flow of sand into the container together with a carrier fluid in the form of a liquid and for discharging accommodated sand at a suitable place after the container's displacement thereto, the container having an outlet and a filter intermediate the closable inlet and the outlet to retain sand within the container, wherein the inlet is provided with a one-way valve configured as a flap valve;

a drive device in form of a pump, a suction side of which is assigned to the outlet of the container, the drive device having a pressure side which is in fluid communicating connection with surroundings within the underwater well in order to establish an under pressure within the container to suck in liquid taking with it sand, the liquid being expelled from the container after the sand has been filtered therefrom; and a sensor assigned to the container and adapted to react to a growing amount of sand within the container in order to, upon the occurrence of a predetermined enclosed amount of sand corresponding to a desired degree of filling, generate a signal that is transferred to at least the pump to stop the pump.

* * * * *